United States Patent [19]

Kazumi et al.

[11] 4,370,925

[45] Feb. 1, 1983

[54] APPARATUS FOR MULTIPLE COLOR PRINTING

[75] Inventors: Ozawa Kazumi, Koga; No Shinichiro, Hooya, both of Japan

[73] Assignee: Kabushiki Kaisha Yakult Honsha, Tokyo, Japan

[21] Appl. No.: 253,756

[22] PCT Filed: Sep. 10, 1980

[86] PCT No.: PCT/JP80/00205

§ 371 Date: Apr. 13, 1981

§ 102(e) Date: Apr. 13, 1981

[87] PCT Pub. No.: WO81/00693

PCT Pub. Date: Mar. 19, 1981

[30] Foreign Application Priority Data

Sep. 10, 1979 [JP] Japan ..... 54-115245

[51] Int. Cl.[3] ..... B41F 17/20

[52] U.S. Cl. ..... 101/40; 198/478; 198/480

[58] Field of Search ..... 101/38 R, 38 A, 39, 101/40; 198/478, 480

[56] References Cited

U.S. PATENT DOCUMENTS

| | | | |
|---|---|---|---|
| 3,124,065 | 3/1964 | Bozek et al. | 101/40 X |
| 3,512,478 | 5/1970 | Rose | 101/38 R |
| 3,521,298 | 7/1970 | Morel et al. | 101/126 X |
| 3,548,745 | 12/1970 | Sirvet et al. | 101/40 |
| 3,640,213 | 2/1972 | Schwartzbach | 101/38 R X |
| 3,645,201 | 2/1972 | Jackson | 101/38 A |
| 3,822,639 | 7/1974 | Szpitalak | 101/40 |
| 3,960,073 | 6/1976 | Rush | 101/40 |
| 4,044,667 | 8/1977 | Jackson | 101/38 R |

*Primary Examiner*—Clifford D. Crowder

*Attorney, Agent, or Firm*—Birch, Stewart, Kolasch & Birch

[57] ABSTRACT

A continuous multicolor printing apparatus for sequentially printing in multicolor the surfaces of cylindrical articles which are successively fed and conveyed at a constant speed on a predetermined locus along which a plurality of rotary printing units is disposed to print the articles, which apparatus comprises article-supporting and conveying means having a locus or path of an irregular configuration, both means being provided separately from one another but operationally coupled in time relationship with each other so that the articles can be successively brought into rolling contact with the printing units to perform the multicolor printing on the surfaces of the articles without experiencing any shear in printing.

1 Claim, 8 Drawing Figures

APPARATUS FOR MULTIPLE COLOR PRINTING

TECHNICAL FIELD

This invention relates to an apparatus for multiple colour printing on the surfaces of cylindrical articles which are successively fed and conveyed by a conveyor unit at a constant speed.

In particular, this invention relates to an apparatus for multiple colour printing on the surface of cylindrical articles which are successively fed and conveyed by the below described constant-speed conveyor unit.

In various kinds of article working processes in factories in a variety of technical fields, a great many apparatuses for conveying articles along a circular conveying locus or path at a constant speed have heretofore been employed. However, no apparatus for conveying articles along a conveying locus or path of a predetermined irregular shape has been known.

We have previously succeeded in providing an apparatus for conveying articles along a conveying locus of a predetermined irregular shape at a constant speed which is essential for effecting various kinds of article working or production processes continuously and efficiently in a variety of factories. We have now succeeded in providing an apparatus for multiple colour printing on the surface of cylindrical articles which are successively conveyed and supplied with use of the said apparatus for conveying.

DISCLOSURE OF INVENTION

The present invention provides a continuous multicolour printing apparatus for printing in multicolour in stepwise manner the surfaces of cylindrical articles which are successively fed and conveyed at a constant speed, which apparatus comprises (a) a conveyor unit (FIGS. 1–4, 7 and 8) adapted to convey articles to be printed at a constant speed which includes a rotary disk 1 having a plurality of bearings 5 mounted on the outer periphery thereof and having a rotating shaft 11 for rotating the disk 1, a conveyor chain or belt 6 arranged to be moved along a predetermined locus or path controlled by inner guides 7 and outer guides 8, a plurality of support means 3 each adapted to support an article to be printed, said support means each having an arm **3*b* and a connecting member 3*c*, freely rotatable shafts 4 each being mounted on one of the bearings 5, the arm 3*b* of the support means being arranged to be slidably fitted in a respective one of the shafts 4, the connecting member 3*c* being connected through a linkage with the conveyor chain 6, a sprocket(s) 2 having a shaft 22 driven by a prime mover and adapted to drive said conveyor chain or belt 6, and a cradle 10, (See FIG. 5) the rotating shaft 11 of the rotary disk 1 being arranged to rotate in synchronism with the rotating shaft 22 of the sprocket 2, (b) cradle rotating units (FIGS. 5, 6 and 8) each including a cradle rotating sprocket 16 adapted to rotate the cradle 10 and having the same diameter as that of the article to be printed, a fixed plate 12 having a configuration similar to that of the predetermined conveying locus or path, a fixed chain or belt 13 stretching around a major part of the outer periphery of the fixed plate 12, said sprocket 16 engaging with the fixed chain or belt 13** so as to be rotated therealong, (c) a plurality of rotary printing units disposed along the conveying locus or path of the articles to be printed, (d) a feeding unit for supplying articles to be printed to the conveyor unit (a), and (e) a delivery unit for delivering printed articles from the conveyor unit (a), all of the rotating means of the units of (a) to (e) above being arranged to rotate in synchronism with one another.

The constant-speed conveyor unit described in (a) above which forms a first characteristic feature of the present invention can successively convey articles to be printed at a constant speed. Stating in brief, in the constant-speed conveyor unit described in (a) above and illustrated in FIGS. 1 and 2, the load of each article to be printed is carried through the bearing 5 by the rotary disk 1. The articles to be printed can be moved at a constant speed, not along the locus of movement of the bearings 5, but along the locus of movement of conveyor chain 6. The articles are supported by the bearings 5 each of which is allowed to rotate by the rotation of the rotary disk 1. Whilst, the connecting member **3*c* of the article support means 3 is connected with the conveyor chain 6 by means of a linkage as shown in FIGS. (5A), (5B) and (5C). The conveyor chain 6 is arranged to be driven by the rotating shaft 22 of the sprocket 2 adapted to be rotated in synchronism with the rotating shaft 11 of the rotary disk 1, as already mentioned. However, the conveyor chain 6 is arranged to move along a predetermined conveying locus or path controlled by inner guides 7 and outer guides 8. Therefore, the article support means 3 connected to the conveyor chain 6 will move along the locus of movement of the conveyor chain 6. Thus, if a point in the article to be printed on the support means 3 is represented by P (see FIG. 1), the point P will basically move by the rotation of the bearings 5, but will ultimately be moved by the conveyor chain 6 (see FIG. 2) which moves along a predetermined conveying locus. Irrespective of the fact that the locus drawn by the circular motion of the bearings 5 is different from that of movement of the conveyor chain 6, because of the rotation of the rotating shafts 4 and the sliding movements of the arms 3*b* of the article support means 3, the point P can be freed from its basic circular motion and instead can be moved along the locus of movement of the conveyor chain 6** when the latter is moved.

Thus, the articles to be printed will basically be moved along the locus of circular motion drawn by the bearings 5 when they are conveyed by the constant-speed conveyor unit set forth in (a), but will ultimately be able to move along a predetermined locus of movement (i.e. the locus of movement of conveyor chain 6). Furthermore, because the connecting members **3*c* of the article support means 3 are coupled with the conveyor chain 6 by means of the linkage, the locus of movement of the conveyor chain 6** will be corrected and then transmitted to the articles to be printed. Therefore, the articles to be printed will be able to move more accurately, thereby enabling the accuracy in multicolour sequential printing to be improved remarkably.

In the cradle rotating units set forth in (b) above (refer to FIGS. 6, 7 and 8) forming a second characteristic feature of the present invention, the rotation of the cradle rotating sprocket 16 which engages with the fixed chain 13 extending under tension around the periphery of the fixed plate 12 having a configuration similar to the locus of movement of the conveyor chain 6 is transmitted to the cradle thereby rotating the latter at a constant speed. The cradle rotating units impart to the articles to be printed a rotary motion while they are being conveyed through the plurality of rotary printing units. Such rotary motion of the articles being printed ensures that the same regions of the articles are prepared for printing at the time of commencement of printing of each rotary printing unit and that the articles being printed are brought into rolling contact with the printing units without causing any slip therebetween thereby enabling clear printing to be achieved.

In brief, in order to ensure accurate printing, it is necessary to rotate each article to be printed by an integral number of revolutions between the commencement of any one of the printing units and that of the next printing unit by setting the number of links of the fixed chain 13 and the number of teeth of the cradle rotating sprocket 16 at a predetermined value, respectively. Further, a sun and planet gear arrangement is formed by the rotary printing units, the cradle rotating sprockets 16 and a fixed chain 13. Stating more specifically, transfer means of the rotary printing arrangement such as for example transfer drums for offset printing are employed as a sun gear, the cradle rotating sprockets 16 are employed as planet gears, the fixed chain 13 is used as an inside gear and the conveyor chain 6 is moved so that these components can make motions similar to those of the sun and planet gear. In this case, the articles to be printed per se are allowed to contact with the rotary printing units. However, because the cradle rotating sprocket and the article to be printed have the same diameter and the same axis of rotation, the articles being printed serve as planet gears.

Thus, the articles to be printed can be brought into rolling contact with the transfer drums of the rotary printing unit, thereby enabling clear printing to be achieved. Further, by positioning the regions of the articles to be printed according to the above-mentioned method, they can be printed in multicolour with high accuracy. It will be understood that by the term "chain" as employed herein is meant a non-sliding wrapping transmission means which covers endless chains and belts which can be rotated in engagement with rotary members such as gears.

The apparatus of this invention comprises the above-mentioned units having the said essential features of the present invention, a plurality of rotary printing units, a feeding unit for supplying articles to be printed and a delivery unit for delivering printed articles. In the apparatus of the present invention, all the rotating means of (a) the constant-speed conveyor unit, (b) the cradle rotating units, (c) the rotary printing units, (d) the feeding unit for supplying articles to be printed and (e) the delivery unit for delivering printed articles are arranged to rotate in a synchronized relationship so that the articles to be printed can be continuously supplied and conveyed at a constant speed, thereby enabling the surfaces of the articles to be printed in multicolour in a stepwise manner with a high degree of accuracy and reliability, the printed articles to be continuously delivered therefrom.

The apparatus of the present invention is applicable to all articles which have a cylindrical shape in the region thereof to be printed.

The apparatus of the present invention is extremely advantageous in that other processing units than the printing units can be installed so that not only printing operation but other kinds of processing operations can be carried out in a continuous flow.

BRIEF DESCRIPTION OF THE DRAWING

FIG. 5 shows an embodiment of article support means;

FIG. 1 is an explanatory view of the arrangement of the constant-speed conveyor unit (a) employed in the multicolour printing apparatus of the instant invention in which the cradle rotating unit set forth in (b) is not shown for the sake of clarity. A plurality of bearings 5 are mounted on the outer periphery of a rotary disk 1 and a freely rotatable shaft 4 are mounted on each of the bearings 5. Slidably fitted in each of the shafts 4 is an arm **3*b* of the article support means 3. The conveyor chain 6 is connected with the connecting member 3*c* of the article support means 3 by means of a linkage as shown in FIGS. 5(A), 5(B) and 5(C). The rotating shaft 22 of the sprocket 2 for driving the conveyor chain 6 is arranged to rotate in synchronism with the rotation of the rotating shaft 11 of the rotary disk 1. FIG. 2 shows the conveyor chain 6 arranged to be moved along a predetermined conveying locus controlled by inner guides 7 and outer guides 8. The conveying locus is not limited to the symmetrical shape as shown in FIG. 2, and it may be non-symmetrical. A desired conveying locus or path can be set provided that the conveyor chain 6** can be moved therealong.

FIG. 3 shows an example wherein processing units other than printing units are combined with the constant-speed conveyor unit set forth in (a). One example in which the feeding unit for supplying articles to be printed is disposed in the region A and the printed article delivery unit is located in the region F is shown in FIG. 4. In the example shown in FIG. 4, articles to be printed are arranged to be supplied to the constant-speed conveyor unit by means of a feed screw 21 and a star wheel 32. Printed articles are arranged to be delivered by the action of star wheel 32 and a delivery belt 31. In the regions B, C, D and E, rotary printing units may be disposed. In FIG. 4, transfer drums 9 are shown to be disposed in those regions. In the case printing units are disposed in all the regions B, C, D and E, it is possible to print articles in four colours in regular sequence. Further, in the case articles to be printed are containers, rotary printing units may be disposed, for example, in the regions B and C, a charging unit for filling the content in the container may be disposed in the region D, and a capper unit may be installed in the region E. In each of the regions B to E, in addition to a rotary printing unit(s), other processing units than the printing units may be installed as desired. Examples of other processing units include charging units for filling content in containers, capper units, sealing units, labelling units or the like. Although the six regions A to F are illustrated in FIGS. 3 and 4, the number of the regions can of course be selected as desired so that a predetermined conveying locus of the conveyor chain 6 can be set (see FIG. 2). FIG. 6 is an explanatory view of the article support means 3 and its associated component parts in which the article to be printed is a bottle 51. Reference numberal 3*a* denotes a frame for holding the bottle, 3*f* a bottle positioning roller, 3*g* a guide rod, 3*h* a ball-shaped caster, 3*b* an arm slidably fitted into rotating shaft 4, 17 a cam, 18 a cam roller and 19 a tension spring for article support means.

The tension spring 19 serves to pull always the article support means 3 towards the rotating shaft 11 of the rotary disk 1 thereby ensuring the engagement of the cradle rotating sprocket 16 with the fixed chain 13. In order to ensure smooth engagement of the sprocket 16 with the fixed chain 13 without causing vibration, the cam 17 and the cam roller 18 are provided. Reference numeral 13 denotes a fixed chain, and 12 a fixed plate for the fixed chain 13. FIG. 7 shows the fixed plate 12 having a shape similar to a predetermined conveying locus of the conveyor chain 6, the fixed chain 13 stretching around and fixedly secured to the outer periphery of the fixed plate 12, the rotary disk 1 and a cam 14. Explaining the manner in which an article to be printed is sent into the support means 3 with reference to FIGS. 6 and 7, upon riding of the article on the cradle 10, a cam plate 14 attached to the chain fixing plate 12 acts to lift the retainer 3*e* through the ball-shaped caster 3*h* and the guide rod 3*g*. Because the fixed chain 13 is arranged not to extend into the article feeding region, the cradle rotating sprocket 16 is not allowed to rotate in the region. An article to be printed is allowed to ride on the cradle 10 while the retainer 3*e* is lifted. Delivery of a printed article can be made in the entirely same manner. FIG. 8 is a fragmentary sectional view explaining the operative relationship between the article support means, the rotary disk 1, the conveyor chain 6 and the fixed chain 13 in which an article to be printed is a bottle as in the case of FIG. 6.

INDUSTRIAL APPLICABILITY

Figure 1:
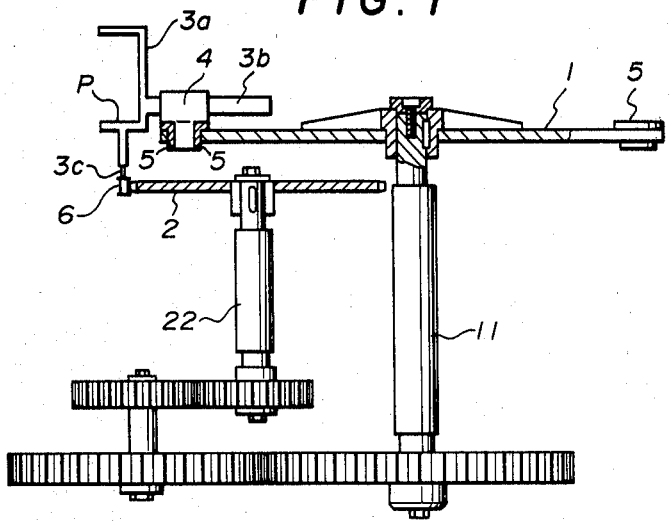
FIG. 1 is an explanatory view of the arrangement of the constant-speed conveyor unit.
Figure 2:
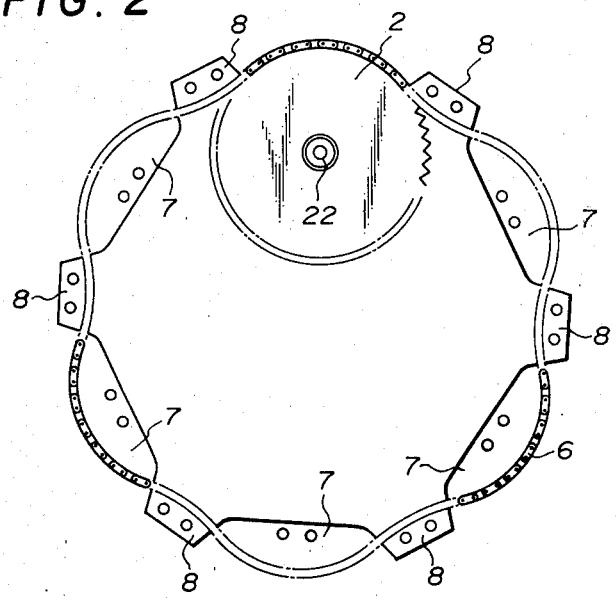
FIG. 2 is another view of the conveyor unit.
Figure 3:
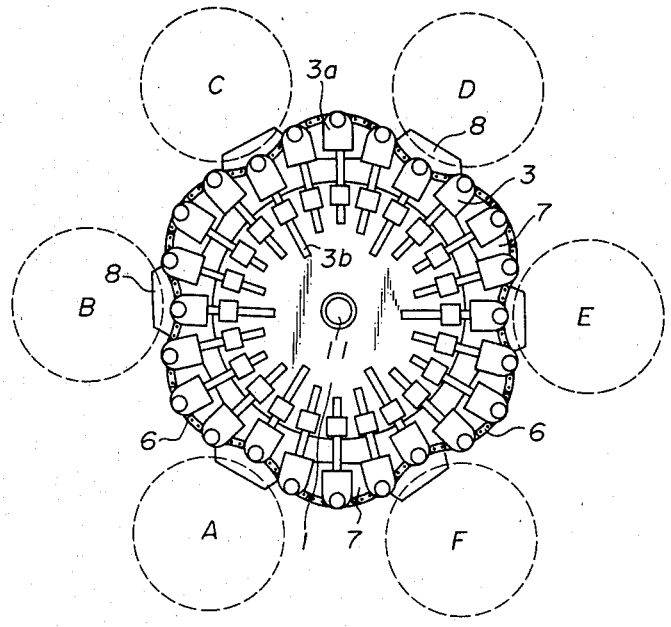
FIG. 3 shows processing units combined with the conveyor unit.
Figure 4:
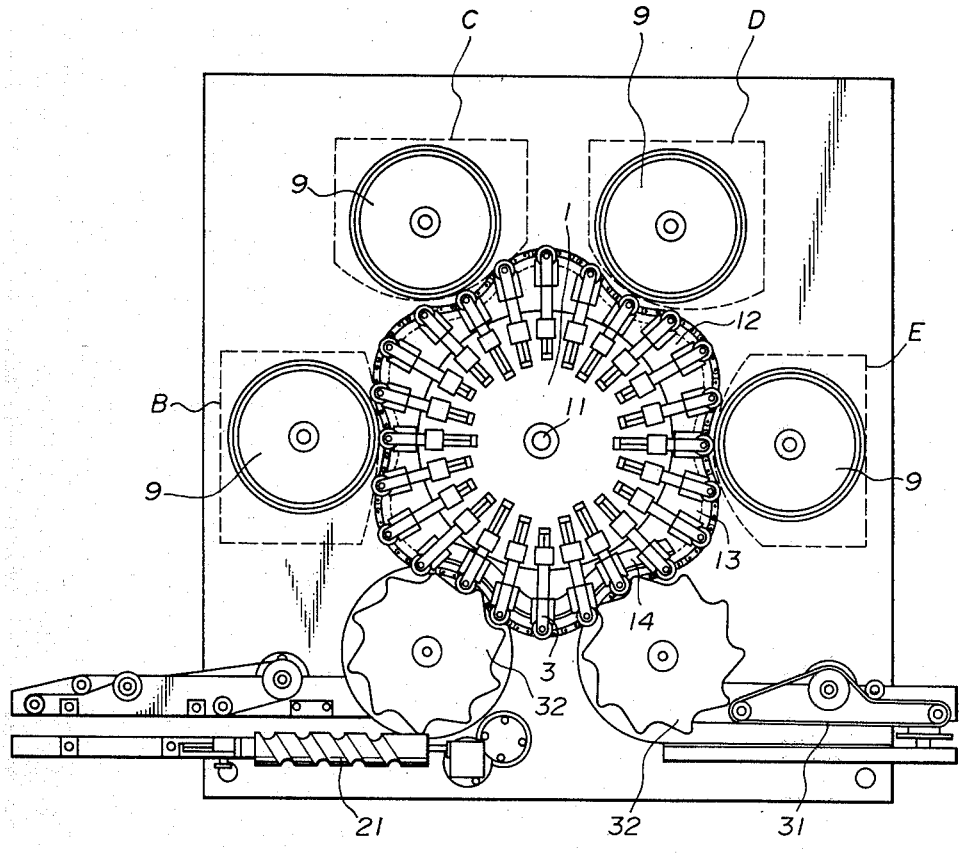
FIG. 4 shows the conveyor unit with feeding and delivering units.
Figure 5A:
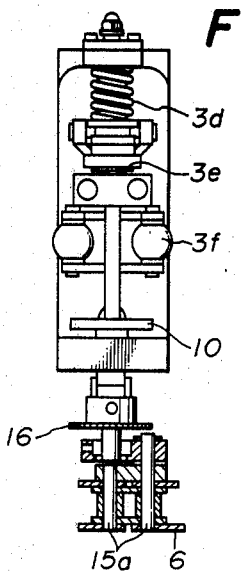
FIG. 5(A) shows one embodiment of the article support means 3 and its interconnection with the conveyor chain 6 by means of a linkage. Reference numeral 3*d* denotes a spring to retain or depress an article such as for example a container, 3*e* a retainer for retaining the container's plug, 3*f* an article positioning roller, 10 a cradle and 15*a* a pin of the linkage.
Figure 5B:
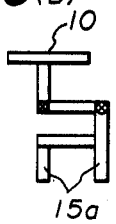
FIGS. 5(B) and 5(C) are schematic views of the linkage.
Figure 5C:
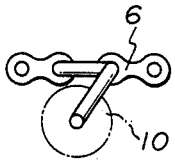
Figure 6:
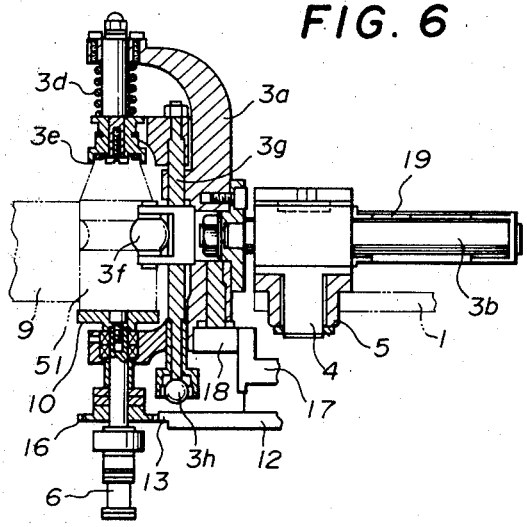
FIG. 6 shows an article support means with an article in place.
Figure 7:
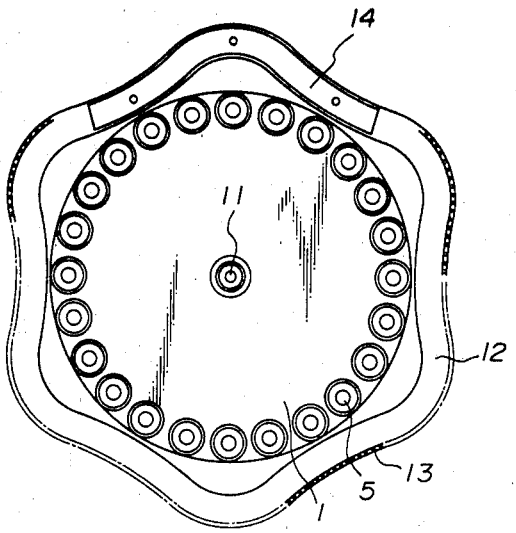
FIG. 7 shows a conveyor unit for use with an article support of FIG. 6.
Figure 8:
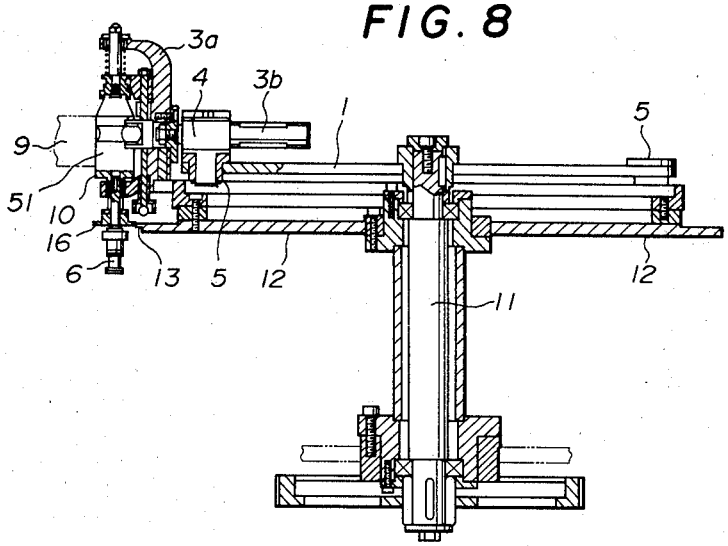
FIG. 8 is a fragmentary sectional view explaining the operative relationship between the conveyor unit and article support.

The continuous multicolour printing apparatus of the present invention is a epoch-making one as a device which is capable of clear multicolour images in stepwise fashion on the surfaces of articles each of which is cylindrical in the regions to be printed and which are successively supplied and conveyed at a constant speed. Furthermore, the apparatus is applicable to any article which has a cylindrical shape in the region thereof to be printed, for example, containers such as bottles, cans, cups, etc., toys, sport goods, dolls, ornamental goods or the like.

Therefore, the apparatus of the present invention has many industrial or commercial uses including the food industry and the pharmaceutical industry.

According to the present invention the printing in multicolour is accomplished very accurately on the surfaces of cylindrical articles which are conveyed by a conveyor unit at a constant speed and successively fed to the apparatus.

The apparatus can be disposed for continuous flow or line system in factories and it requires only a small space for its installation.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

I claim:

1. A continuous multicolor printing apparatus for sequentially printing the surfaces of cylindrical articles which are successively fed and conveyed at a constant speed, comprising a conveyor unit adapted to convey said articles at a constant speed, said conveyor unit including a rotary disk having a plurality of bearings mounted on the outer periphery thereof and having a rotating shaft for rotating said disk, a conveyor chain arranged to be moved along a predetermined locus controlled by inner and outer guides, a plurality of support means each having a cradle for supporting an article to be printed, a plurality of rotary printing units disposed along the conveying locus of said articles, cradle rotating units for rotating said cradle to allow the articles to be brought into rolling contact with said printing units, a feeding unit for supplying the articles to the conveyor and a delivery unit for delivering printed articles from the apparatus, said support means including an arm, a frame for holding said article to be printed and a connecting member, a freely rotatable shaft mounted on each one of said bearings, said arm of said support means being arranged to be slidably fitted into each respective rotatable shaft, said connecting member being connected through a linkage with said conveyor chain, a sprocket having a further shaft driven by a prime mover and adapted to drive said conveyor chain, said rotating shaft of said rotary disk being arranged to rotate synchronously with said rotating shaft of said sprocket, said cradle rotating units each including a cradle rotating sprocket adapted to rotate said cradle, a fixed plate having a configuration similar to that of said conveying locus and a fixed chain stretching around a major part of the outer periphery of said fixed plate, said sprocket engaging said fixed chain so as to be moved therealong.

* * * * *

UNITED STATES PATENT AND TRADEMARK OFFICE

CERTIFICATE OF CORRECTION

PATENT NO. : 4,370,925

DATED : February 1, 1983

INVENTOR(S) : Kazumi Ozawa and Shinichiro No

It is certified that error appears in the above—identified patent and that said Letters Patent is hereby corrected as shown below:

In the category "[75] Inventors", change "Ozawa Kazumi, Koga; No Shinichiro, Hooya, both of Japan" to -- Kazumi Ozawa, Koga; Shinichiro No, Hooya, both of Japan --

Signed and Sealed this

*Thirty-first* Day of *July 1984*

[SEAL]

*Attest:*

GERALD J. MOSSINGHOFF

*Attesting Officer*

*Commissioner of Patents and Trademarks*